US007459635B2

(12) United States Patent
Belli et al.

(10) Patent No.: US 7,459,635 B2
(45) Date of Patent: Dec. 2, 2008

(54) CONTINUOUS PROCESS FOR MANUFACTURING ELECTRICAL CABLES

(75) Inventors: Sergio Belli, Milan (IT); Alberto Bareggi, Milan (IT); Gaia Dell'Anna, Milan (IT); Cristiana Scelza, Milan (IT); Fabrizio Donazzi, Milan (IT)

(73) Assignee: Prysmian Cavi E Sistemi Energia S.R.L., Milan (IT)

( * ) Notice: Subject to any disclaimer, the term of this patent is extended or adjusted under 35 U.S.C. 154(b) by 0 days.

(21) Appl. No.: 10/565,783

(22) PCT Filed: Jul. 25, 2003

(86) PCT No.: PCT/EP03/08194

§ 371 (c)(1),
(2), (4) Date: Aug. 8, 2006

(87) PCT Pub. No.: WO2005/015577

PCT Pub. Date: Feb. 17, 2005

(65) Prior Publication Data

US 2007/0181333 A1 Aug. 9, 2007

(51) Int. Cl.
*H01B 7/00* (2006.01)

(52) U.S. Cl. ..... 174/110 R; 174/113 A; 174/120 R

(58) Field of Classification Search ..... 174/110 R, 174/113 R, 120 R, 120 SC, 110 F
See application file for complete search history.

(56) References Cited

U.S. PATENT DOCUMENTS

| | | | | |
|---|---|---|---|---|
| 3,516,859 | A * | 6/1970 | Heinz et al. | 427/118 |
| 4,104,210 | A * | 8/1978 | Coran et al. | 525/232 |
| 4,469,539 | A | 9/1984 | Wade et al. | |
| 4,711,811 | A * | 12/1987 | Randa | 428/383 |
| 4,963,695 | A * | 10/1990 | Marciano-Agostinelli et al. | 174/23 C |
| 5,110,998 | A * | 5/1992 | Muschiatti | 174/24 |
| 5,153,381 | A * | 10/1992 | Ganatra et al. | 174/102 R |
| 5,281,757 | A * | 1/1994 | Marin et al. | 174/23 R |
| 5,926,949 | A | 7/1999 | Moe et al. | |
| RE36,307 | E | 9/1999 | Marin et al. | |
| 2002/0143114 | A1 | 10/2002 | Barioz | |

FOREIGN PATENT DOCUMENTS

| | | |
|---|---|---|
| CH | 682778 | 11/1993 |
| EP | 0 324 430 | 7/1989 |
| EP | 0 426 073 | 5/1991 |
| EP | 1 288 218 | 3/2003 |
| IT | WO 98/52197 | * 11/1998 |
| WO | WO 98/52197 | 11/1998 |
| WO | WO 01/46965 | 6/2001 |
| WO | WO 02/47092 | 6/2002 |

* cited by examiner

*Primary Examiner*—William H Mayo, III
(74) *Attorney, Agent, or Firm*—Finnegan, Henderson, Farabow, Garrett & Dunner, L.L.P.

(57) ABSTRACT

A process for manufacturing an electric cable. In particular, the process includes the steps of: a) feeding a conductor at a predetermined feeding speed; b) extruding a thermoplastic insulating layer in a position radially external to the conductor; c) cooling the extruded insulating layer; and d) forming a circumferentially closed metal shield around the extruded insulating layer. The process may be carried out continuously, i.e., the time occurring between the end of the cooling step and the beginning of the shield forming step is inversely proportional to the feeding speed of the conductor.

19 Claims, 6 Drawing Sheets

CONTINUOUS PROCESS FOR MANUFACTURING ELECTRICAL CABLES

CROSS REFERENCE TO RELATED APPLICATION

This application is a national phase application based on PCT/EP2003/008194, filed Jul. 25, 2003, the content of which is incorporated herein by reference.

BACKGROUND OF THE INVENTION

1. Field of the Invention

The present invention relates to a process for manufacturing electrical cables, in particular electrical cables for power transmission or distribution at medium or high voltage.

In the present description, the term medium voltage is used to refer to a tension typically from about 1 kV to about 60 kV and the term high voltage refers to a tension above 60 kV (very high voltage is also sometimes used in the art to define voltages greater than about 150 kV or 220 kV, up to 500 kV or more).

Said cables may be used for both direct current (DC) or alternating current (AC) transmission or distribution.

2. Description of the Related Art

Cables for power transmission or distribution at medium or high voltage generally have a metal conductor which is surrounded, respectively, with a first inner semiconductive layer, an insulating layer and an outer semiconductive layer. In the following of the present description, said group of elements will be indicated with the term of "core".

In a position radially external to said core, the cable is provided with a metal shield (or screen), usually of aluminium, lead or copper.

The metal shield may consist of a number of metal wires or tapes, helically wound around the core, or of a circumferentially continuous tube, such as a metallic tape shaped according to a tubular form and welded or sealed to ensure hermeticity.

The metal shield performs an electrical function by creating, inside the cable, as a result of direct contact between the metal shield and the outer semiconductive layer of the core, a uniform electrical field of the radial type, at the same time cancelling the external electrical field of the cable. A further function is that of withstanding short-circuit currents.

When made in circumferentially continuous tubular form, the metal shield also provides hermeticity against water penetration in the radial direction.

An example of metal shields is described in U.S. Re36,307.

In a configuration of the unipolar type, said cable further comprises a polymeric oversheath in a position radially external to the metal shield mentioned above.

Moreover, cables for power transmission or distribution are generally provided with one or more layers for protecting said cables from accidental impacts which may occur on their external surface.

Accidental impacts on a cable may occur, for example, during transport thereof or during the laying step of the cable in a trench dug into the soil. Said accidental impacts may cause a series of structural damages to the cable, including deformation of the insulating layer and detachment of the insulating layer from the semiconductive layers, damages which may cause variations in the electrical voltage stress of the insulating layer with a consequent decrease in the insulating capacity of said layer.

Cross-linked insulation cables are known and their manufacturing process is described, for example, in EP1288218, EP426073, US2002/0143114, and U.S. Pat. No. 4,469,539.

The cross-linking of the cable insulation can be made either by using the so-called silane cross-linking or by using peroxides.

In the first case, the cable core, comprising the extruded insulation surrounding the conductor, is maintained for a relatively long period of time (hours or days) in a water-containing ambient (either liquid or vapor, such as ambient humidity), such that the water can diffuse through the insulation to cause the cross-linking to take place. This requires the cable core to be coiled on spools of fixed length, fact which inherently prevents a continuous process to be carried out.

In the second case, the cross-linking is caused by the decomposition of a peroxide, at relatively high temperature and pressure. The chemical reactions that take place generate gaseous byproducts which must be allowed to diffuse through the insulation layer not only during the curing time but also after the curing. Therefore a degassing step has to be provided during which the cable core is stored for a period of time sufficient to eliminate such gaseous byproducts before further layers are applied over the cable core (in particular in case such layers are gas-tight or substantially gas-tight, such as in the case a longitudinally folded metal layer is applied).

In the practical experience of the Applicant, in the absence of a degassing stage prior to further layers application, it may happen that under particular environmental conditions (e.g. remarkable solar irradiation of the cable core) said byproducts expands thus causing undesired deformations of the metal shield and/or of the polymeric oversheath.

Furthermore, in the case a degassing step is not provided, the gaseous byproducts (e.g. methane, acetophenone, cuminic alcohol) remain trapped within the cable core due to the presence of the further layers applied thereto and can exit the cable only from the ends thereof. This is particularly dangerous since some of said byproducts (e.g., the methane) are inflammable and thus explosions may occur, for instance during laying or joining of said cables in the trench dug into the soil.

Furthermore, in the absence of a degassing stage prior to further layers application, it may happen that porosity in the insulation is found which can deteriorate the insulation electric properties.

A process for producing a cable having thermoplastic insulation is described in WO02/47092, in the name of the same Applicant, where a cable is produced by extruding and passing through a static mixer a thermoplastic material, comprising a thermoplastic polymer mixed with a dielectric liquid, such thermoplastic material being applied around a conductor by means of an extrusion head. After a cooling and a drying step, the cable core is stored on a reel and then a metal shield is applied by helically placing thin strips of copper or copper wires onto the cable core. An outer polymer sheath then completes the cable.

The continuous supply of the cable core with extruded insulation to the shield application unit was not contemplated. In fact the shield was of a type only suitable for a non-continuous application process since it required the use of spools mounted on a rotating apparatus, as further explained in the following.

SUMMARY OF THE INVENTION

The Applicant has perceived that the presence of a rest phase during the cable production, for example for curing or degassing purposes, is undesirable because it limits the length of each cable piece (storage on cable reels being required), it introduces space and logistic problems in the factory, it extends the cable manufacturing time and, finally, it increases the cost of the cable production.

According to an aspect of the present invention, the Applicant has perceived that a cable can be produced in a particularly convenient manner by a continuous process, i.e. in the absence of intermediate resting or storage phases, by using a thermoplastic insulation material in combination with a longitudinally folded, circumferentially continuous metal shield.

In a first aspect, the present invention refers to a continuous process for manufacturing an electric cable, said process comprising the phases of:

feeding a conductor at a predetermined feeding speed;

extruding a thermoplastic insulating layer radially external to the conductor;

cooling the extruded insulating layer;

forming a circumferentially closed metal shield around said extruded insulating layer;

characterized in that the time occurring between the end of the cooling phase and the beginning of the shield forming phase is inversely proportional to the feeding speed of the conductor.

In particular, the circumferentially closed metal shield around the extruded insulating layer is formed by longitudinally folding a metal sheet, either having overlapping edges or edge-bonded edges.

Preferably, the phase of forming the metal shield according to the process of the present invention comprises the step of overlapping the edges of a metal sheet. Alternatively, said phase of forming comprises the step of bonding the edges of said metal sheet.

Preferably, the process comprises the phase of supplying the conductor in the form of a metal rod.

Furthermore, preferably the process of the present invention comprises the phase of applying an impact protecting element around the metal shield. Preferably, said impact protecting element is applied by extrusion. Preferably, said impact protecting element comprises a non-expanded polymeric layer and an expanded polymeric layer. Preferably, the expanded polymeric layer is positioned radially external to the non-expanded polymeric layer. Preferably, the non-expanded polymeric layer and the expanded polymeric layer are applied by co-extrusion.

The process of the invention generally further comprises the phase of applying an oversheath around the metal shield. Preferably, the oversheath is applied by extrusion.

Preferably, the impact protecting element is applied between the closed metal shield and the oversheath.

Preferably, the thermoplastic polymer material of the insulating layer includes a predetermined amount of a dielectric liquid.

Furthermore, the Applicant has found that the cable obtained by the continuous process of the present invention is surprisingly provided with high mechanical resistance to accidental impacts which may occur on the cable.

In particular, the Applicant has found that a high impact protection is advantageously conferred to the cable by combining a circumferentially closed metal shield with an impact protecting element comprising at least one expanded polymeric layer, the latter being located radially external to the metal shield.

Furthermore, the Applicant has noticed that, in case a deformation of the shield occurs due to a relevant impact on the cable, the presence of a circumferentially closed metal shield is particularly advantageous since the shield deforms continuously and smoothly, thereby avoiding any local increases of the electric field in the insulating layer.

Moreover, the Applicant has found that a cable provided with a thermoplastic insulating layer, a circumferentially closed metal shield and an impact protecting element comprising at least one expanded polymeric layer can be advantageously obtained by means of a continuous manufacturing process.

Furthermore, the Applicant has found that the mechanical resistance to accidental impacts can be advantageously increased by providing the cable with a further expanded polymeric layer in a position radially internal with respect to the metal shield.

Preferably, said further expanded polymeric layer is a water-blocking layer.

In a second aspect the present invention refers to an electrical cable comprising:

a conductor;

a thermoplastic insulating layer radially external to the conductor;

at least one expanded polymeric layer around said insulating layer;

a circumferentially closed metal shield around said insulating layer, and an impact protecting element in a position radially external to the metal shield, said impact protecting element comprising at least one non-expanded polymeric layer around said metal shield and at least one expanded polymeric layer radially external to said non-expanded polymeric layer.

BRIEF DESCRIPTION OF THE DRAWINGS

Further details will be illustrated in the detailed description which follows, with reference to the appended drawings, in which.

DETAILED DESCRIPTION OF THE INVENTION

Figure 1:
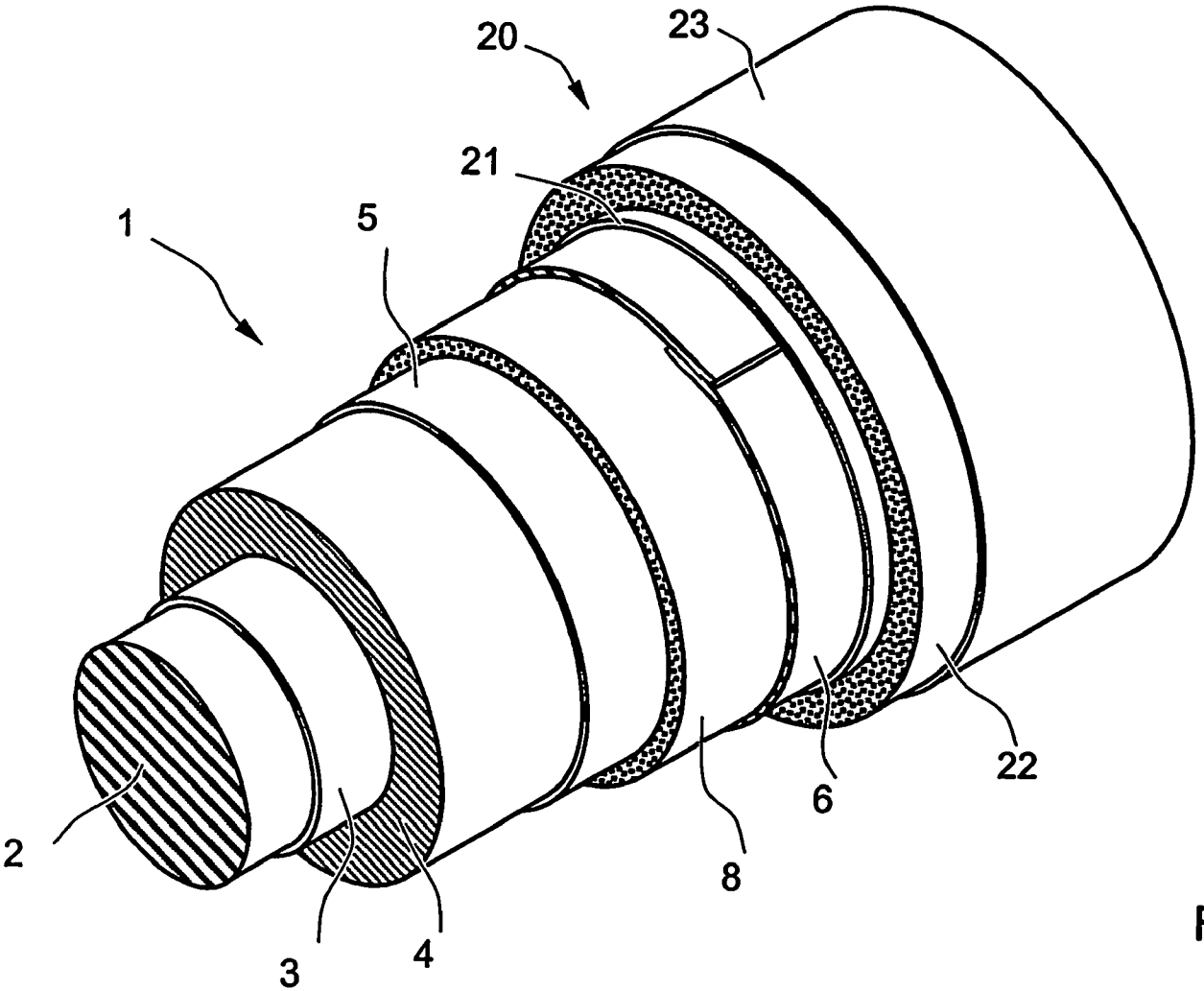
FIG. 1 is a perspective view of an electrical cable according to a first embodiment of the present invention.
Figure 2:
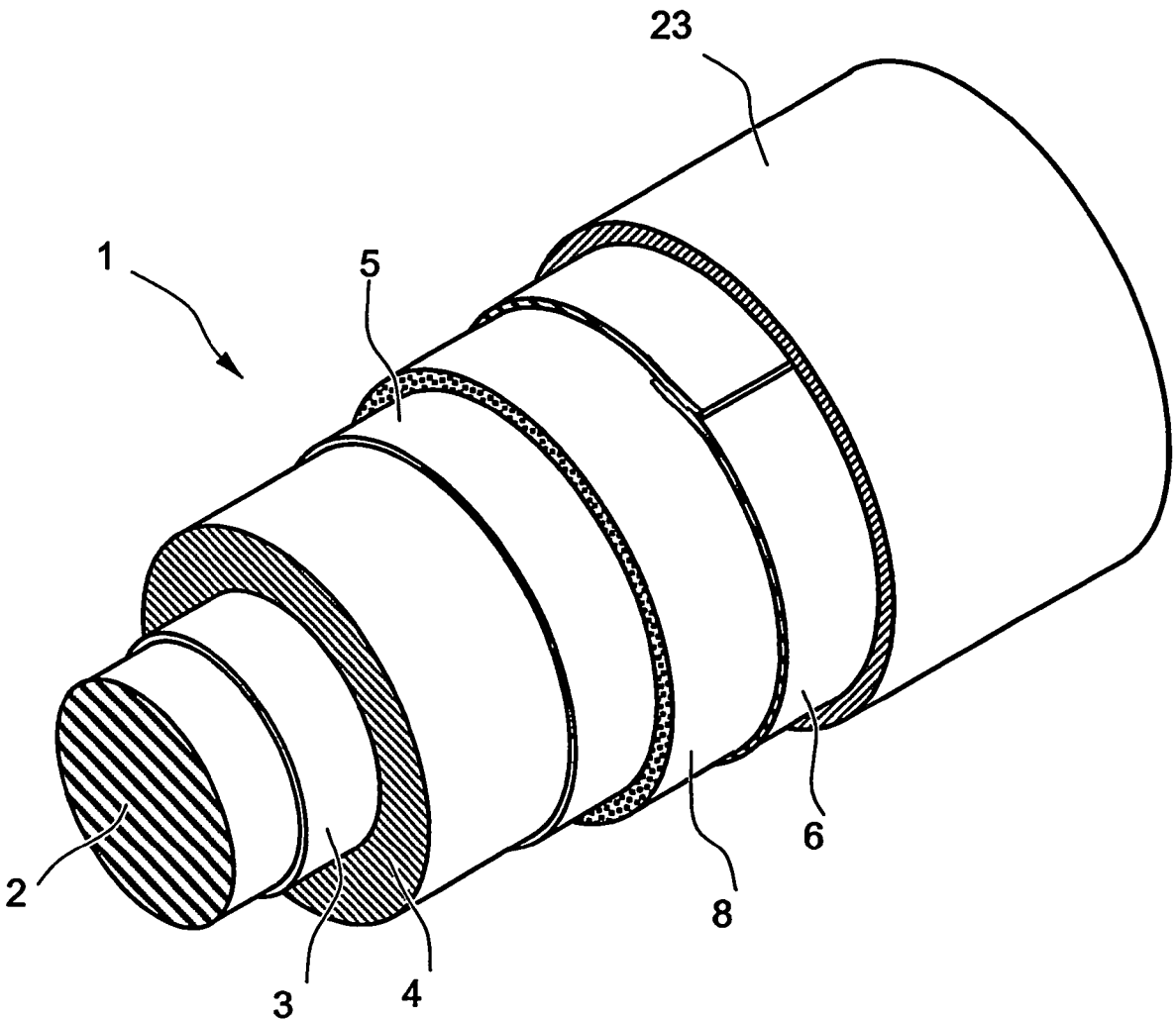
FIG. 2 is a perspective view of an electrical cable according to a second embodiment of the present invention.

FIGS. 1, 2 show a perspective view, partially in cross section, of an electrical cable 1, typically designed for use in medium or high voltage range, which is made with the process according to the present invention.

The cable 1 comprises: a conductor 2; an inner semiconductive layer 3; an insulating layer 4; an outer semiconductive layer 5; a metal shield 6 and a protective element 20.

Preferably, the conductor 2 is a metal rod. Preferably, the conductor is made of copper or aluminium.

Alternatively, the conductor 2 comprises at least two metal wires, preferably of copper or aluminium, which are stranded together according to conventional techniques.

The cross sectional area of the conductor 2 is determined in relationship with the power to be transported at the selected voltage.

Preferred cross sectional areas for cables according to the present invention range from 16 $mm^2$ to 1,600 $mm^2$.

In the present description, the term "insulating material" is used to indicate a material having a dielectric rigidity of at least 5 kV/mm, preferably greater than 10 kV/mm. For medium-high voltage power transmission cables (i.e. voltage greater than about 1 kV), preferably the insulating material has a dielectric rigidity greater than 40 kV/mm.

Typically, the insulating layer of power transmission cables has a dielectric constant (K) of greater than 2.

The inner semiconductive layer 3 and the outer semiconductive layer 5 are generally obtained by extrusion.

The base polymeric materials of the semiconductive layers 3, 5, which are conveniently selected from those mentioned in the following of the present description with reference to the expanded polymeric layer, are additivated with an electroconductive carbon black, for example electroconductive furnace black or acetylene black, so as to confer semiconductive properties to the polymer material. In particular, The surface area of the carbon black is generally greater than 20 $m^2/g$, usually between 40 and 500 $m^2/g$. Advantageously, a highly conducting carbon black may be used, having a surface area of at least 900 $m^2/g$, such as, for example, the furnace carbon black known commercially under the tradename Ketjenblack® EC (Akzo Chemie NV). The amount of carbon black to be added to the polymer matrix can vary depending on the type of polymer and of carbon black used, the degree of expansion which it is intended to obtain, the expanding agent, etc. The amount of carbon black thus has to be such as to give the expanded material sufficient semiconductive properties, in particular such as to obtain a volumetric resistivity value for the expanded material, at room temperature, of less than 500 Ω·m, preferably less than 20 Ω·m. Typically, the amount of carbon black can range between 1 and 50% by weight, preferably between 3 and 30% by weight, relative to the weight of the polymer.

In a preferred embodiment of the present invention, the inner and outer semiconductive layers 3, 5 comprise a non-crosslinked polymeric material, more preferably a polypropylene material.

Preferably the insulating layer 4 is made of a thermoplastic material which comprises a thermoplastic polymer material including a predetermined amount of a dielectric liquid.

Preferably the thermoplastic polymer material is selected from: polyolefins, copolymers of different olefins, copolymers of an olefin with an ethylenically unsaturated ester, polyesters, polyacetates, cellulose polymers, polycarbonates, polysulphones, phenol resins, urea resins, polyketones, polyacrylates, polyamides, polyamines, and mixtures thereof. Examples of suitable polymers are: polyethylene (PE), in particular low density PE (LDPE), medium density PE (MDPE), high density PE (HDPE), linear low density PE (LLDPE), ultra-low density polyethylene (ULDPE); polypropylene (PP); ethylene/vinyl ester copolymers, for example ethylene/vinyl acetate (EVA); ethylene/acrylate copolymers, in particular ethylene/methyl acrylate (EMA), ethylene/ethyl acrylate (EEA) and ethylene/butyl acrylate (EBA); ethylene/α-olefin thermoplastic copolymers; polystyrene; acrylonitrile/butadiene/styrene (ABS) resins; halogenated polymers, in particular polyvinyl chloride (PVC); polyurethane (PUR); polyamides; aromatic polyesters such as polyethylene terephthalate (PET) or polybutylene terephthalate (PBT); and copolymers thereof or mechanical mixtures thereof.

Preferably, the dielectric liquid can be selected from: mineral oils such as, for example, naphthenic oils, aromatic oils, paraffinic oils, polyaromatic oils, said mineral oils optionally containing at least one heteroatom selected from oxygen, nitrogen or sulphur; liquid paraffins; vegetable oils such as, for example, soybean oil, linseed oil, castor oil; oligomeric aromatic polyolefins; paraffinic waxes such as, for example, polyethylene waxes, polypropylene waxes; synthetic oils such as, for example, silicone oils, alkyl benzenes (such as, for example, dibenzyltoluene, dodecylbenzene, di(octylbenzyl)toluene), aliphatic esters (such as, for example, tetraesters of pentaerythritol, esters of sebacic acid, phthalic esters), olefin oligomers (such as, for example, optionally hydrogenated polybutenes or polyisobutenes); or mixtures thereof. Aromatic, paraffinic and naphthenic oils are particularly preferred.

In the preferred embodiments shown in FIGS. 1 and 2, the metal shield 6 is made of a continuous metal sheet, preferably of aluminium or copper, which is shaped as a tube.

The metal sheet forming the metal shield 6 is folded lengthwise around the outer semiconductive layer 5 with overlapping edges.

Conveniently, a sealing and bonding material is interposed between the overlapping edges, so as to make the metal shield watertight. Alternatively, the metal sheet edges may be welded.

As shown in FIGS. 1 and 2, the metal shield 6 is surrounded by an oversheath 23 preferably made of a non-crosslinked polymer material, for example polyvinyl chloride (PVC) or polyethylene (PE); the thickness of such oversheath can be selected to provide the cable with a certain degree of resistance to mechanical stresses and impacts, however without excessively increasing the cable diameter and rigidity. Such solution is convenient, for example, for cables intended for use in protected areas, where limited impacts are expected or protection is otherwise provided.

According to a preferred embodiment, shown in FIG. 1, which is particularly convenient when an enhanced impact protection is desired, the cable 1 is provided with a protective element 20, located in a position radially external to said metal shield 6. According to said embodiment, the protective element 20 comprises a non-expanded polymeric layer 21 (in a radial internal position) and an expanded polymeric layer 22 (in a radial external position). According to the embodiment of FIG. 1, the non-expanded polymeric layer 21 is in contact with the metal shield 6 and the expanded polymeric layer 22 is between the non-expanded polymeric layer 21 and the polymeric oversheath 23.

The thickness of the non-expanded polymeric layer 21 is in the range of from 0.5 mm to 5 mm.

The thickness of the expanded polymeric layer 22 is in the range of from 0.5 mm to 6 mm.

Preferably, the thickness of the expanded polymeric layer 22 is from 1 to two times the thickness of the non-expanded polymeric layer 21.

The protective element 20 has the function of providing enhanced protection to the cable from external impacts, by at least partially absorbing the impact energy.

The expandable polymeric material which is suitable for being used in the expanded polymeric layer 22 can be selected from the group comprising: polyolefins, copolymers of different olefins, copolymers of an olefin with an ethylenically unsaturated ester, polyesters, polycarbonates, polysulphones, phenol resins, urea resins, and mixtures thereof. Examples of suitable polymers are: polyethylene (PE), in particular low density PE (LDPE), medium density PE (MDPE), high density PE (HDPE), linear low density PE (LLDPE), ultra-low density polyethylene (ULDPE); polypropylene (PP); elastomeric ethylene/propylene copolymers (EPR) or ethylene/propylene/diene terpolymers (EPDM); natural rubber; butyl rubber; ethylene/vinyl ester copolymers, for example ethylene/vinyl acetate (EVA); ethylene/acrylate copolymers, in particular ethylene/methyl acrylate (EMA), ethylene/ethyl acrylate (EEA) and ethylene/butyl acrylate (EBA); ethylene/α-olefin thermoplastic copolymers; polystyrene; acrylonitrile/butadiene/styrene (ABS) resins; halogenated polymers, in particular polyvinyl chloride (PVC); polyurethane (PUR); polyamides; aromatic polyesters such as polyethylene terephthalate (PET) or polybutylene terephthalate (PBT); and copolymers thereof or mechanical mixtures thereof.

Preferably, the polymeric material forming the expanded polymeric layer 22 is a polyolefin polymer or copolymer based on ethylene and/or propylene, and is selected in particular from:

(a) copolymers of ethylene with an ethylenically unsaturated ester, for example vinyl acetate or butyl acetate, in which the amount of unsaturated ester is generally between 5% by weight and 80% by weight, preferably between 10% by weight and 50% by weight;

(b) elastomeric copolymers of ethylene with at least one $C_3$-$C_{12}$ α-olefin, and optionally a diene, preferably ethylene/propylene (EPR) or ethylene/propylene/diene (EPDM) copolymers, generally having the following composition: 35%-90% mole of ethylene, 10%-65% mole of α-olefin, 0%-10% mole of diene (for example 1,4-hexadiene or 5-ethylidene-2-norbomene);

(c) copolymers of ethylene with at least one $C_4$-$C_{12}$ α-olefin, preferably 1-hexene, 1-octene and the like, and optionally a diene, generally having a density of between 0.86 g/cm$^3$ and 0.90 g/cm$^3$ and the following composition: 75%-97% by mole of ethylene; 3%-25% by mole of α-olefin; 0%-5% by mole of a diene;

(d) polypropylene modified with ethylene/$C_3$-$C_{12}$ α-olefin copolymers, wherein the weight ratio between polypropylene and ethylene/$C_3$-$C_{12}$ α-olefin copolymer is between 90/10 and 10/90, preferably between 80/20 and 20/80.

For example, the commercial products Elvax® (DuPont), Levapren® (Bayer) and Lotryl® (Elf-Atochem) are in class (a), products Dutral® (Enichem) or Nordel® (Dow-DuPont) are in class (b), products belonging to class (c) are Engage® (Dow-DuPont) or Exacts® (Exxon), while polypropylene modified with ethylene/alpha-olefin copolymers (d) are commercially available under the brand names Moplen® or Hifax® (Basell), or also Fina-Pro® (Fina), and the like.

Within class (d), particularly preferred are thermoplastic elastomers comprising a continuous matrix of a thermoplastic polymer, e.g. polypropylene, and fine particles (generally having a diameter of the order of 1 μm-10 μm) of a cured elastomeric polymer, e.g. crosslinked EPR o EPDM, dispersed in the thermoplastic matrix.

The elastomeric polymer may be incorporated in the thermoplastic matrix in the uncured state and then dynamically crosslinked during processing by addition of a suitable amount of a crosslinking agent.

Alternatively, the elastomeric polymer may be cured separately and then dispersed into the thermoplastic matrix in the form of fine particles.

Thermoplastic elastomers of this type are described, e.g. in U.S. Pat. No. 4,104,210 or in European Patent Application EP 324,430. These thermoplastic elastomers are preferred since they proved to be particularly effective in elastically absorb radial forces during the cable thermal cycles in the whole range of working temperatures.

For the purposes of the present description, the term "expanded" polymer is understood to refer to a polymer within the structure of which the percentage of "void" volume (that is to say the space not occupied by the polymer but by a gas or air) is typically greater than 10% of the total volume of said polymer.

In general, the percentage of free space in an expanded polymer is expressed in terms of the degree of expansion (G). In the present description, the term "degree of expansion of the polymer" is understood to refer to the expansion of the polymer determined in the following way:

$$G(\text{degree of expansion})=(d_0/d_e-1)$$

where $d_0$ indicates the density of the non-expanded polymer (that is to say the polymer with a structure which is essentially free of void volume) and $d_e$ indicates the apparent density measured for the expanded polymer.

Preferably, the degree of expansion of the expanded polymeric layer 22 is chosen in the range of from 0.35 to 0.7, more preferably from 0.4 to 0.6.

Preferably, the non-expanded polymeric layer 21 and the oversheath 23 are made of polyolefin materials, usually polyvinyl chloride or polyethylene.

As shown in FIGS. 1 and 2, the cable 1 is further provided with a water-blocking layer 8 placed between the outer semiconductive layer 5 and the metal shield 6.

Preferably, the water-blocking layer 8 is an expanded, water swellable, semiconductive layer.

An example of an expanded, water swellable, semiconductive layer is described in International Patent Application WO 01/46965 in the name of the Applicant.

Preferably, the expandable polymer of the water-blocking layer 8 is chosen from the polymeric materials mentioned above for use in the expanded layer 22.

Preferably, the thickness of the water-blocking layer 8 is in the range of from 0.2 mm and 1.5 mm.

Said water-blocking layer 8 aims at providing an effective barrier to the longitudinal water penetration to the interior of the cable.

The water swellable material is generally in a subdivided form, particularly in the form of powder. The particles constituting the water-swellable powder have preferably a diameter not greater than 250 μm and an average diameter of from 10 μm to 100 μm. More preferably, the amount of particles having a diameter of from 10 μm to 50 μm are at least 50% by weight with respect to the total weight of the powder.

The water-swellable material generally consists of a homopolymer or copolymer having hydrophilic groups along the polymeric chain, for example: crosslinked and at least partially salified polyacrylic acid (for example, the products Cabloc® from C. F. Stockhausen GmbH or Waterlock® from Grain Processing Co.); starch or derivatives thereof mixed with copolymers between acrylamide and sodium acrylate (for example, products SGP Absorbent Polymers from Henkel AG); sodium carboxymethylcellulose (for example, the products Blanose® from Hercules Inc.).

The amount of water-swellable material to be included in the expanded polymeric layer is generally of from 5 phr to 120 phr, preferably of from 15 phr to 80 phr (phr=parts by weight with respect to 100 parts by weight of base polymer).

In addition, the expanded polymeric material of the water-blocking layer 8 is modified to be semiconductive by adding a suitable electroconductive carbon black as mentioned above with reference to the semiconductive layers 3, 5.

Furthermore, by providing the cable of FIG. 1 with an expanded polymer material having semiconductive properties and including a water-swellable material (i.e. the semiconductive water-blocking layer 8), a layer is formed which is capable of elastically and uniformly absorbing the radial forces of expansion and contraction due to the thermal cycles to which the cable is subjected during use, while ensuring the necessary electrical continuity between the cable and the metal shield.

Moreover, the presence of the water-swellable material dispersed into the expanded layer is able to effectively block moisture and/or water, thus avoiding the use of water-swellable tapes or of free water-swellable powders.

Furthermore, by providing the cable of FIG. 1 with the semiconductive water-blocking layer 8, the thickness of the outer semiconductive layer 5 may be advantageously reduced since the electrical property of the outer semiconductive layer 5 is partially performed by said water-blocking semiconductive layer. Therefore, said aspect advantageously contributes to the reduction of the outer semiconductive layer thickness and thus of the overall cable weight.

Manufacturing Process and Plant

Figure 3:
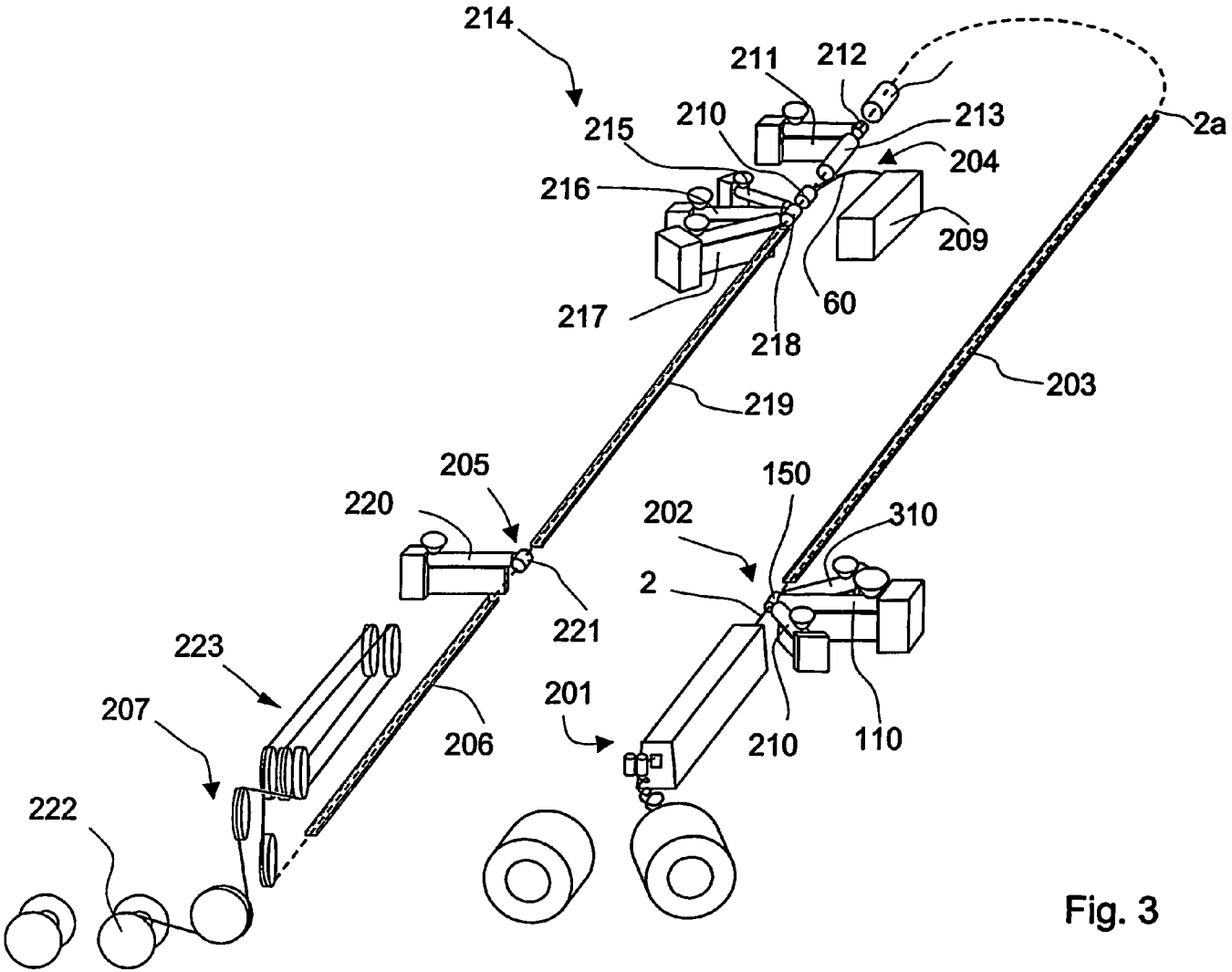
FIG. 3 diagrammatically represents a plant for the production of cables according to the process of the present invention.

As show in FIG. 3, a plant for the production of cables according to the present invention comprises: a conductor supply unit 201, a first extrusion section 202 for the obtainment of the insulating layer 4 and the semiconductive layers 3 and 5, a cooling section 203, a metal shield application section 204, a second extrusion section 214 for applying the protective element 20, an oversheath extrusion section 205, a further cooling section 206 and a take up section 207.

Conveniently, the conductor supply unit 201 comprises an apparatus for rolling a metal rod to the desired diameter for the cable conductor (providing the required surface finishing).

In case connection of metal rod lengths is required to produce in continuous the final cable length as required by the application (or by other customers requirements), the conductor supply unit 201 conveniently comprises apparatus for welding and thermally treating the conductor, as well as accumulating units suitable to provide sufficient time for the welding operation without affecting the continuous, constant speed delivery of the conductor itself.

The first extrusion section 202 comprises a first extruder apparatus 110, suitable to extrude the insulating layer 4 on the conductor 2 supplied by the conductor supply unit 201; the first extruder apparatus 110 is preceded, along the direction of advancement of the conductor 2, by a second extruder apparatus 210, suitable to extrude the inner semiconductive layer 3 on the outer surface of the conductor 2 (and beneath the insulating layer 4), and followed by a third extruder apparatus 310, suitable to extrude the outer semiconductive layer 5 around the insulating layer 4, to obtain the cable core 2*a*.

The first, second and third extruder apparatus may be arranged in succession, each with its own extrusion head, or, preferably, they are all connected to a common triple extrusion head 150 to obtain the co-extrusion of said three layers.

An example of structure suitable for the extruder apparatus 110 is described in WO02/47092 in the name of the same Applicant.

Conveniently, second and third extruder apparatus have a similar structure as the first extruder apparatus 110 (unless different arrangements are required by the specific materials to be applied).

The cooling section 203, through which the cable core 2*a* is passed, may consist of an elongated open duct, along which a cooling fluid is caused to flow. Water is a preferred example of such cooling fluid. The length of such cooling section, as well as the nature, temperature and flow rate of the cooling fluid, are determined to provide a final temperature suitable for the subsequent steps of the process.

A drier 208 is conveniently inserted prior to entering into the subsequent section, said drier being effective to remove residuals of the cooling fluid, such as humidity or water droplets, particularly in case such residuals turn out to be detrimental to the overall cable performance.

The metal shield application section 204 includes a metal sheet delivery apparatus 209 which is suitable to supply a metal sheet 60 to an application unit 210.

In a preferred embodiment, the application unit 210 includes a former (not shown) by which the metal sheet 60 is folded lengthwise into a tubular form so as to surround the cable core 2*a*, advancing therethrough, and to form the circumferentially closed metal shield 6.

A suitable sealing and bonding agent can be supplied in the overlapping area of the edges of the sheet 60 so as to form the circumferentially closed metal shield 6.

Alternatively, a suitable sealing and bonding agent can be supplied at the edges of the sheet 60 so as to form the circumferentially closed metal shield 6.

The use of a longitudinally folded metal shield is particularly convenient in that it contributes to enable to produce the cable with a continuous process, without requiring the use of complex spool rotating machines, which would otherwise be needed in case of a multi-wire (or tape) spirally wound metal shield.

If convenient for the specific cable design, a further extruder 211, equipped with an extrusion head 212, is located upstream from the application unit 210, together with a cooler 213, to apply the expanded semiconductive layer 8 around the cable core 2*a*, beneath the metal shield 6.

Preferably, the cooler 213 is a forced air cooler.

If no additional impact protection is required, the cable is finished by passing it through the oversheath extrusion section 205, which includes an oversheath extruder 220 and its extrusion head 221.

After the final cooling section 206, the plant includes the take-up section 207 by which the finished cable is coiled on a spool 222.

Preferably, the take-up section 207 includes an accumulation section 223 which allows to replacing of a completed spool with an empty one without interruption in the cable manufacturing process.

In case an enhanced impact protection is desired, a further extrusion section 214 is located downstream the application unit 210.

In the embodiment shown in FIG. 3, the extrusion section 214 comprises three extruders 215, 216, 217, equipped with a common triple extrusion head 218.

In more details, the extrusion section 214 is suitable for applying a protective element 20 comprising an expanded polymeric layer 22 and a non-expanded polymeric layer 21. The non-expanded polymeric layer 21 is applied by the extruder 216 while the expanded polymeric layer 22 is applied by the extruder 217.

Furthermore, the extrusion section 214 comprises a further extruder 215 which is provided for applying a primer layer that is suitable for improving the bonding between the metal shield 6 and the protective element 20 (i.e. the non-expanded polymeric layer 21).

A cooling section 219 is conveniently present downstream the further extrusion section 214.

Figure 4:
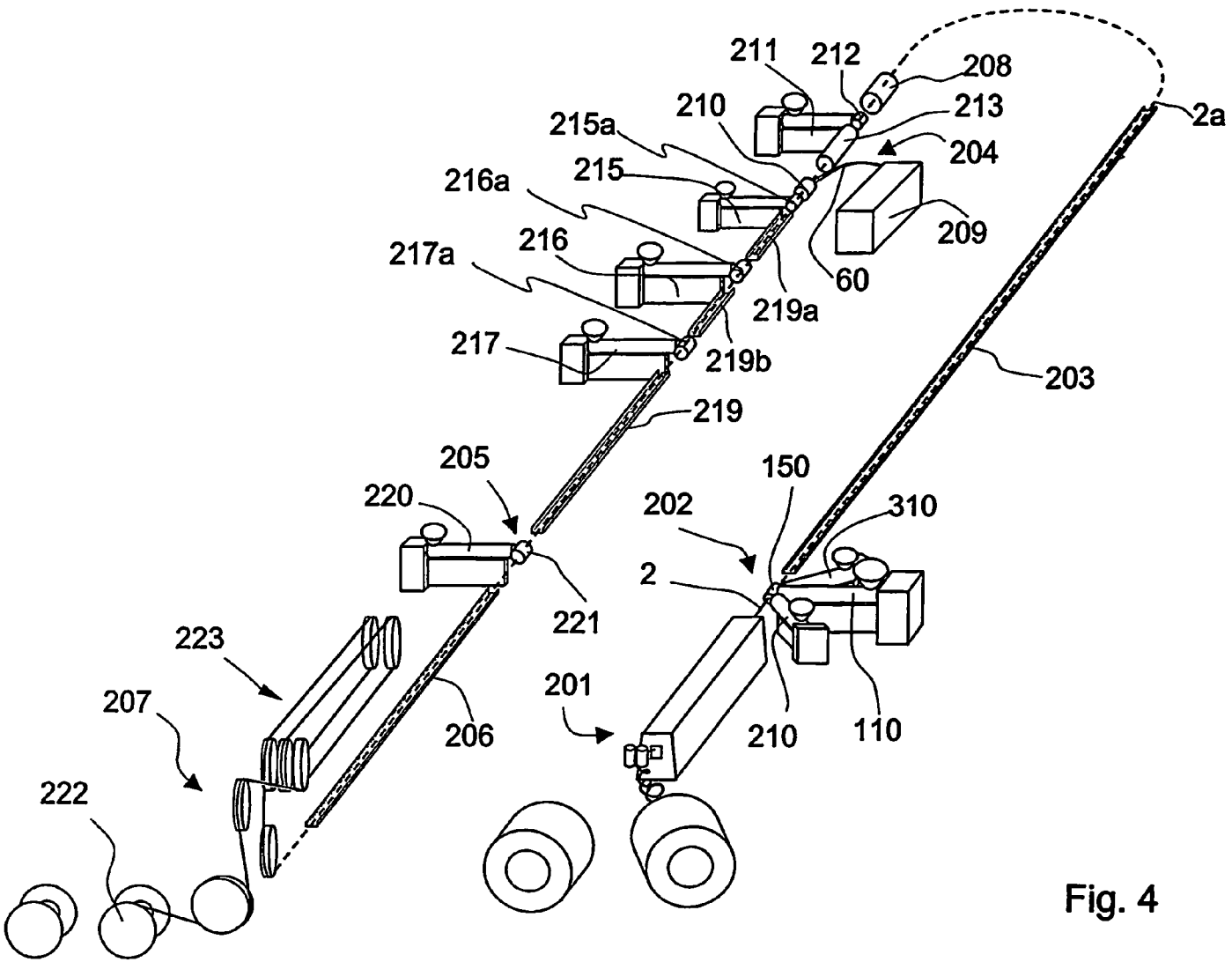
FIG. 4 diagrammatically represents an alternative plant for the production of cables according to the process of the present invention.

FIG. 4 shows a plant similar to the one of FIG. 3, according to which the extruders 215, 216, 217 are separate from each other and three distinct independent extrusion heads 215*a*, 216*a*, 217*a* are provided.

Separate cooling channels or ducts 219*a* and 219*b* are present after the extruder 215 and 216 respectively, while the cooling channel 219 is located after the extruder 217.

According to a further embodiment (not shown) the primer layer and the non-expanded polymeric layer 21 are applied together by co-extrusion and, successively, the extrusion of the expanded polymeric layer 22 is performed.

According to a further embodiment (not shown) the primer layer and the non-expanded polymeric layer 21 are applied together by co-extrusion and, successively, the expanded polymeric layer 22 and the oversheath 23 are applied together by co-extrusion. Alternatively, the primer layer and the non-expanded polymeric layer 21 are applied separately by using two distinct extrusions heads 215*a*, 216*a*, while the expanded polymeric layer 22 and the oversheath 23 are applied together by co-extrusion.

In FIGS. 3 and 4 the layout of the manufacturing plant is U-shaped in order to reduce the longitudinal dimensions of the factory. In the figures, the advancement of the cable is reversed at the end of the cooling section 203 by means of any suitable device known in the art, e.g by means of rollers.

Alternatively, the layout of the manufacturing plant is develops longitudinally and no reversing of the cable feeding direction is present.

Continuous Manufacturing Process

With the plant described above, the cable can be produced with a continuous process.

In the present description, by "continuous process" it is meant a process in which the time required to manufacture a given cable length is inversely proportional to the advancement speed of the cable in the line, so that intermediate rest phases are missing between the conductor supply and the finished cable take-up.

According to the present invention the conductor is continuously supplied from the supply unit 201.

The supply unit 201 is arranged to allow continuous delivery of the conductor.

The conductor is conveniently made of a single metal rod (typically aluminium or copper). In this case, the continuous delivery of the conductor is enabled by connecting the available length of the metal rod (typically loaded on a spool or the like) to a further length of the metal rod.

Such connection can be made, for example, by welding the rod ends.

According to the continuous process of the present invention, the maximum length of the produced cable is determined by the customer's or installer's requirements, such as the length of the line to be laid (between two intermediate stations), the maximum dimension of the shipping spool to be used (with the relevant transport limitations), the maximum installable length and the like, and not by the available raw material or semi-finished product length or machinery capacity. In this way it is possible to install electrical lines with a minimum number of joints between cable lengths, so as to increase the line reliability since cable joints are known to be points of discontinuity which are prone to electrical problems during the use of the line.

In case a stranded conductor is desired, rotating machines are required for stranding and the conductor is conveniently prepared off-line in the required length and the splicing operation is difficult. In such case, the length of the manufactured cables is determined by the available stranded conductor length (which can be predetermined on the basis of the customers requirements) and/or by the capacity of the shipping spools, while the process remains otherwise continuous from the conductor supply up to the end.

The extrusion of the insulating layer 4, the semiconductive layers 3 and 5, the oversheath 23, the protective element 20 (if any) and the water blocking layer 8 (if any) can be carried out continuously since the various materials and compounds to be extruded are supplied to the relevant extruders inlets without interruption.

As no cross-linking step is required, because of the use of thermoplastic, non-cross-linked materials, in particular for the insulating layer, no process interruption is required.

As a matter of fact, conventional, cross-linked insulation cables production processes include a "rest" phase, in which the insulated conductor is maintained off-line for a certain period of time (hours or even days) to allow: a) the cross-linking reactions to take place, in case silane-crosslinking is used or b) the emission of gases resulting as cross-linking reactions by-products, in case of peroxide cross-linking.

The rest phase of case a) can be carried out by introducing the cable (wound on a supporting reel) into an oven or by immerging the same in water at a temperature of about 80° C. so as to improve the cross-linking reaction speed.

The rest phase of case b), i.e. the degassing phase, can be carried out by introducing the cable (wound on a supporting reel) into an oven so as to decrease the degassing time.

This "rest" phase is typically effected by coiling the semi-finished element on spools at the end of the extrusion of the relevant layers.

After that, the cross-linked, semifinished element is supplied to another, independent line, where the cable is completed.

According to the process of the present invention, the metal shield 6 is formed from a longitudinally folded metal sheet which is conveniently unwound from a spool that is mounted on a stationary apparatus while it is free to rotate about its rotating axis so that the sheet can be unwound from the spool. Accordingly, in the process of the present invention the metal sheet can be supplied with no interruptions since the rear end of the sheet of the spool in use can be easily connected (e.g. by welding) to the front end of the sheet which is loaded on a new spool. Generally, an appropriate sheet accumulation apparatus is further provided.

This would not be possible in case a helical type shield is used (either formed by helically wound wires or tapes) because in such case the spools carrying the wires or tapes would be loaded in a rotating apparatus, revolving around the cable, and the replacement of empty spools with new ones would require an interruption in the cable advancement.

However, it is possible to provide the cable with a metal shield made of wire or tapes while keeping the manufacturing process continuous, by using an apparatus according to which said wires/tapes are applied onto the cable according to S and Z stranding operations to be carried out alternatively. In such a case the reels supporting said wire/tapes are not constrained to be rotatably moved around the cable.

However, the use of a longitudinally folded metal shield has been found particularly convenient in connection with the use of thermoplastic insulating and semiconductive layers.

As a matter of fact, as mentioned above, in case a cross-linked material is used, after the cross-linking reaction is completed, it is necessary that a certain period of time is provided in order to allow the gaseous byproducts to be emitted. Conventionally, this is obtained by allowing the semifinished product (i.e. the cable core) to rest for a certain period of time after the cross-linking reaction occurred. In case a circumferentially non-continuous metal shield is used (as in case of wires or tapes helically wound around the cable core) the gas emission may take place also by diffusion through the metal shield (e.g. through the wires or the tape overlapping areas) and through the extruded layers positioned radially external to the metal shield.

However, in case a longitudinally folded metal shield is used, it extends circumferentially around the whole perimeter of the cable core, thereby forming a substantially impervious envelope, which substantially prevents further evacuation of the gaseous byproducts. Accordingly, when a longitudinally folded metal shield is used in connection with cross-linked insulating layers, the degassing of this material should be substantially completed before the metal shield is applied.

On the contrary, the use for the cable insulating layer of thermoplastic, non cross-linked materials, which do not emit cross-linking gaseous byproducts (and, accordingly, do not require any degassing phase), in combination with a longitudinally folded metal sheet as cable metal shield enables the cable manufacturing process to be continuous since no "rest" phase is needed off-line.

For further description of the invention, an illustrative example is given below.

EXAMPLE 1

The following example describes in detail the main steps of a continuous production process of a 150 $mm^2$, 20 kV cable according to FIG. 1. The line speed is set at 60 m/min.

a) Cable Core Extrusion

The cable insulating layer is obtained by feeding directly into the hopper of the extruder 110 a propylene heterophase copolymer having melting point 165° C., melting enthalpy 30 J/g, MFI 0.8 dg/min and flexural modulus 150 MPa (Adflex® Q 200 F—commercial product of Basell).

Subsequently, the dielectric oil Jarylec® Exp3 (commercial product of Elf Atochem—dibenzyltoluene), previously mixed with the antioxidants, is injected at high pressure into the extruder.

The extruder 110 has a diameter of 80 mm and an L/D ratio of 25.

The injection of the dielectric oil is made during the extrusion at about 20 D from the beginning of the screw of the extruder 110 by means of three injections point on the same cross-section at 120° from each other. The dielectric oil is injected at a temperature of 70° C. and a pressure of 250 bar.

Corresponding extruders are used for the inner and the outer semiconductive layers.

A rod-shaped aluminum conductor 2 (cross-section 150 $mm^2$) is fed through the triple extruder head 150.

The cable core 2*a* leaving the extrusion head 150 is cooled by passing through the channel shaped cooling section 203 where cold water is made to flow.

The resulting cable core 2*a* has an inner semiconductive layer of about 0.5 mm thickness, an insulating layer of about 4.5 mm thickness and an outer semiconductive layer of about 0.5 mm thickness.

b) Cable Water Blocking Semiconductive Expanded Layer

The water blocking semiconductive expanded layer 8, having a thickness of about 0.7 mm and a degree of expansion of 0.6 is applied on the cable core 2*a* by the extruder 211 which has a diameter of 60 mm and a L/D ratio of 20.

The material for said expanded layer 8 is given in Table 1 below. The material is chemically expanded by adding about 2% of the expanding agent Hydrocerol® CF 70 (carboxylic acid+sodium bicarbonate) into the extruder hopper.

TABLE 1

| COMPOUNDS | QUANTITY (phr) |
|---|---|
| Elvax ® 470 | 100 |
| Ketjenblack ® EC 300 | 20 |
| Irganox ® 1010 | 0.5 |
| Waterloock ® J 550 | 40 |
| Hydrocerol ® CF 70 | 2 |

wherein:
Elvax ® 470: ethylene/vinyl acetate (EVA) copolymer (commercial product of DuPont);
Ketjenblack ® EC 300: high-conductive furnace carbon black (commercial product of Akzo Chemie);
Irganox ® 1010: pentaerythryl-tetrakis[3-(3,5-di-t-butyl-4-hydroxyphenyl) propionate] (commercial product of Ciba Specialty Chemicals);
Waterloock ® J 550: grounded crosslinked polyacrylic acid (partially salified) (commercial product of Grain Processing);
Hydrocerol ® CF 70: carboxylic acid/sodium bicarbonate expanding agent (commercial product of Boeheringer Ingelheim).

After the extrusion head 212 of the extruder 211, cooling is provided by the forced air cooler 213.

c) Cable Metal Shield Application

The cable core 2*a*, provided with the expanded semiconductive layer 8, is then covered—by means of the application unit 210—by a longitudinally folded lacquered aluminum sheet of about 0.3 mm thickness, using an adhesive to bond the overlapping edges thereof.

The adhesive is applied by means of the extruder 215.

d) Cable Protective Element Application

Subsequently, the inner polymeric layer 21, made of polyethylene, of about 1.5 mm thickness is extruded over the aluminium shield by means of the extruder 216 having a diameter of 120 mm and a L/D ratio of 25.

According to the process plant of FIG. 3, the expanded polymeric layer 22, having a thickness of about 2 mm and a degree of expansion of 0.55, is co-extruded with the non-expanded inner polymeric layer 21.

The expanded polymeric layer 22 is applied by means of the extruder 217 which has a diameter of 120 mm and an L/D ratio of 25.

The material for the expanded polymeric layer 22 is given in Table 2 below.

TABLE 2

| COMPOUNDS | QUANTITY (phr) |
|---|---|
| Hifax ® SD 817 | 100 |
| Hydrocerol ® BiH40 | 1.2 |

wherein:
Hifax ® SD 817: propylene modified with ethylene/propylene copolymer, commercially produced by Basell;
Hydrocerol ® BiH40: carboxylic acid + sodium bicarbonate expanding agent, commercially produced by Boeheringer Ingelheim.

The polymeric material is chemically expanded by adding the expanding agent (Hydrocerol® BiH40) into the extruder hopper.

At a distance of about 500 mm from the extrusion head 218 a cooling section 219, in the form of a pipe or channel through which cold water is flown, stops the expansion and cools the extruded material before extruding the outer non-expanded polymeric layer 23.

e) Cable Oversheath Extrusion

Subsequently, the oversheath 23, made of polyethylene, of about 1.5 mm thickness is extruded using the extruder 220 having a diameter of 120 mm and a L/D ratio of 25.

The cable leaving the extrusion head 221 is finally cooled in a cooling section 206 through which cold water is flown.

The cooling of the finished cable can be carried out by using a multi-passage cooling channel which advantageously reduces the longitudinal dimensions of the cooling section.

Impact and Load Resistance

In the presence of a mechanical stress applied to the cable, such as an impact applied on the outer surface of the cable or a significant local load, suitable to cause a deformation of the cable itself, it has been observed that, even in case the deformation involves also the insulation, for example because the impact energy exceeds the admissible value capable of being supported by the impact protection layer, or in case the protective element is selected with relatively small thickness, the deformation profile of the metal shield follows a continuous, smooth line, thereby avoiding local increases of the electric field.

Generally, the materials used for the insulating layer and the oversheath of the cable elastically recover only part of their original size and shape after the impact, so that after the impact, even if it has taken place before the cable is energized, the insulating layer thickness withstanding the electric stress is reduced.

However, the Applicant has observed that, when a metal shield is used outside the cable insulating layer, the material of such shield is permanently deformed by the impact, further limiting the elastic recover of the deformation, so that the insulating layer is restrained from elastically recovering its original shape and size.

Consequently, the deformation caused by the impact, or at least a significant part thereof, is maintained after the impact, even if the cause of the impact itself has been removed.

Said deformation results in that the insulating layer thickness changes from the original value $t_0$ to a "damaged" value $t_d$. (see FIG. 5).

Accordingly, when the cable is being energized, the real insulating layer thickness which is bearing the electric voltage stress ($\Gamma$) in the impact area is no more $t_0$, but rather $t_d$.

Figure 5:
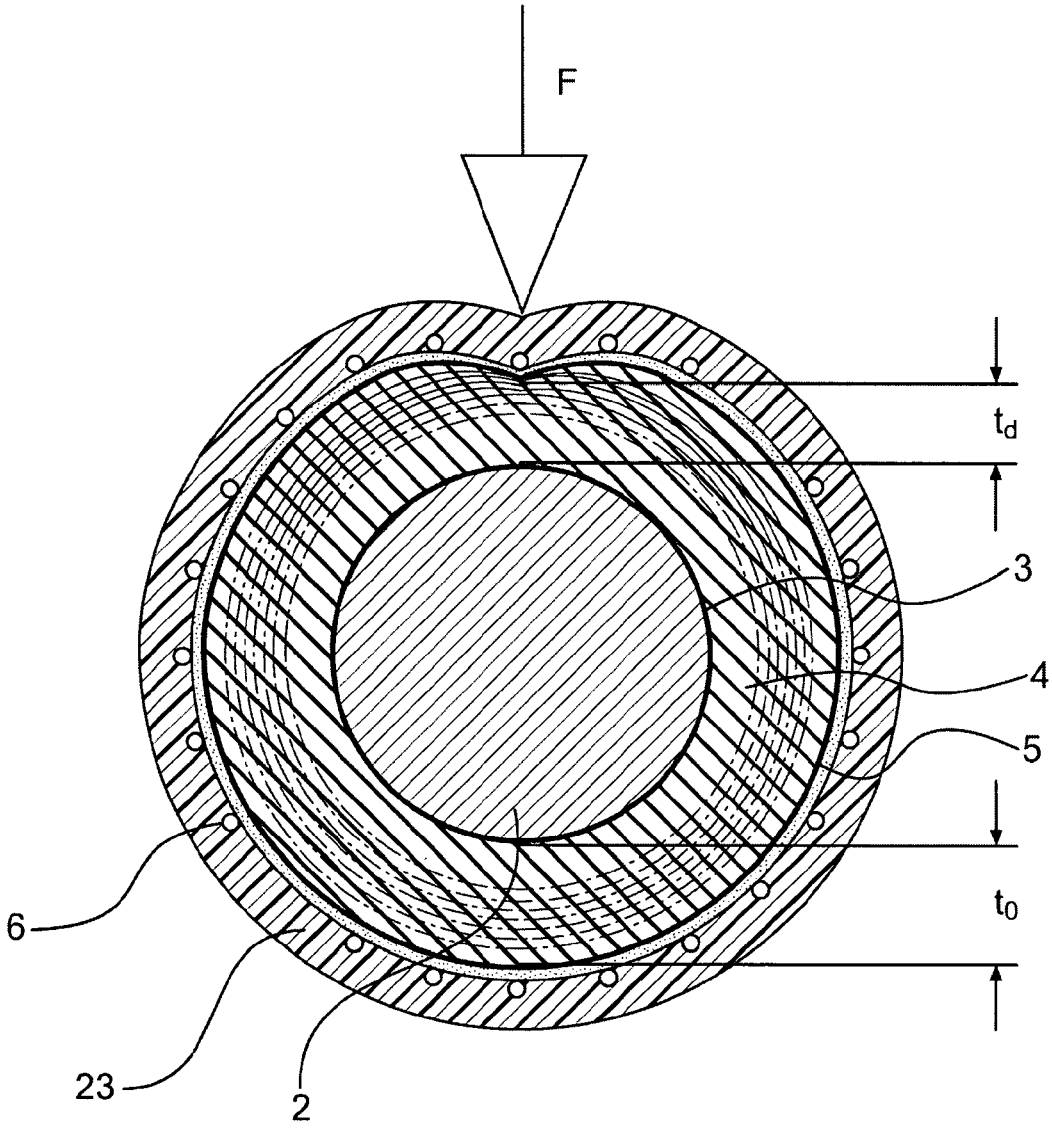
FIG. 5 is a cross-sectional view of an electrical cable made according to the present invention, damaged by an impact.
Figure 6:
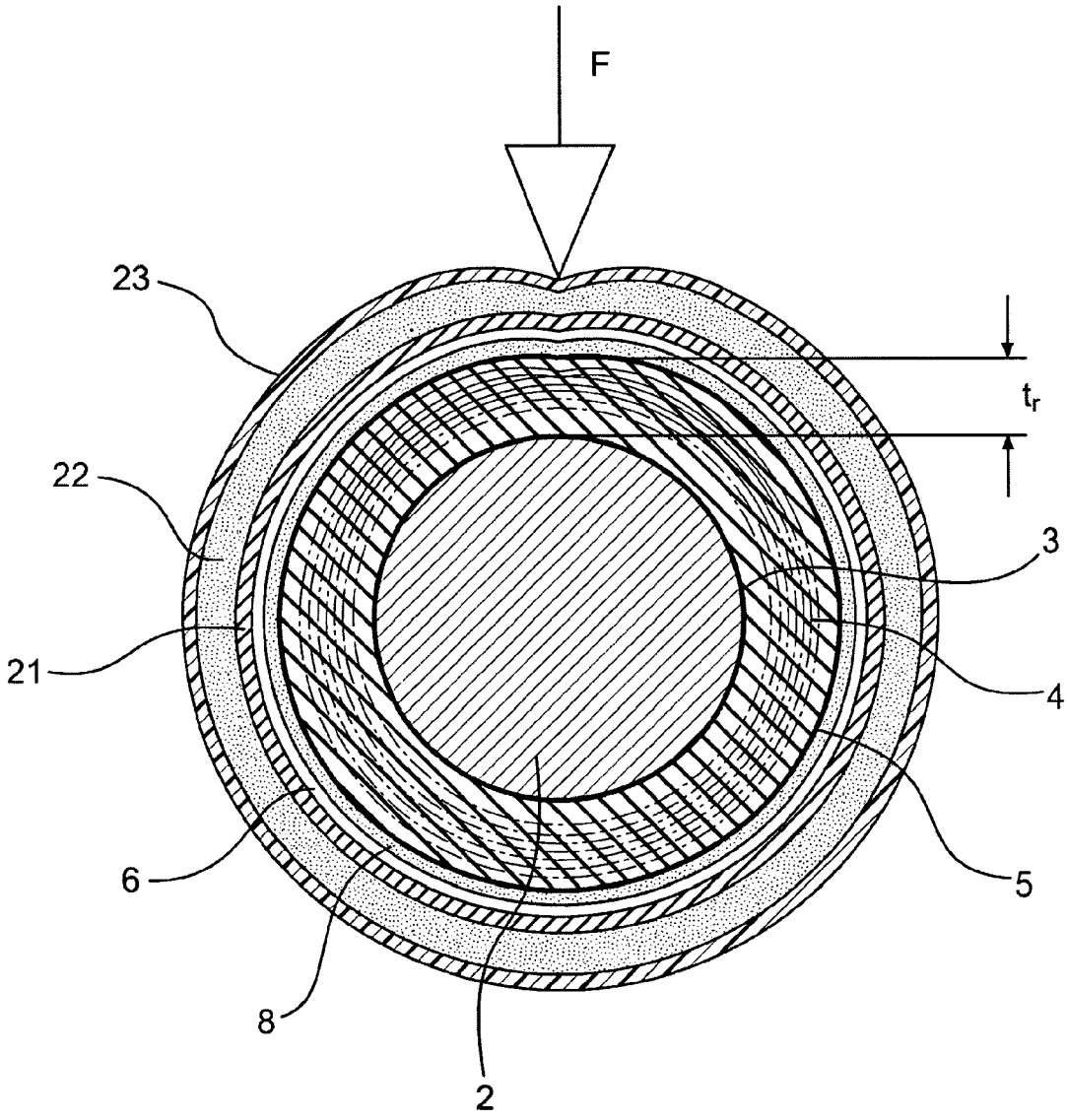
FIG. 6 is a cross-sectional view of a traditional electrical cable provided with a shield made of wires, damaged by an impact.

In addition, when an impact is made against a cable having a metal shield of "discontinuous" type, e.g. made of helically wound wires or tapes, either in case an impact protecting layer is absent (as shown in FIG. 5) or even in the presence of an impact protecting layer (of compact or expanded type), the uneven resistance of the metal shield wires structure causes the wire located closer to the impact area to be significantly deformed and transmit such deformation to the underlying layers as a "local" deformation, with minimal involvement of the neighbouring areas.

In the insulating layer, this results in a "spike" effect, which causes a deformation of the otherwise circular equipotential lines of the electric field in the impact area, as shown in FIG. 5, where the original circular equipotential lines are drawn with dotted lines and the deformed lines are drawn with continuous lines.

The deformation of the equipotential lines of the electric field causes them to get closer in the impact area, which means that the electric gradient in this area becomes significantly higher. This local increase of the electric gradient is likely to cause electrical discharges to take place, determining the (impacted) cable failure in a partial discharge electric test, even in case of impacts of relatively low energy.

In case the metal shield is made of a longitudinally folded metal sheet, particularly when combined with an expanded protective element, however, the Applicant has discovered that the local deformation of the shield and of the underlying insulating layer is significantly reduced.

As a matter of fact, the expanded protecting element, continuously supported by the underlying metal shield, is capable to distribute the impact energy on a relatively large area around the impact position, as shown in FIG. 8.

Accordingly, the deformation of the equipotential lines of the electric field is reduced (and associated with a larger area as well), so that they get less close than in the case of the helical wires described above, with an impact of the same energy.

As a result, the local electric gradient increase caused by the impact is minimized and the cable ability to withstand partial discharge tests is significantly increased.

The invention claimed is:

1. An electrical cable comprising:

a conductor;

a thermoplastic insulating layer radially external to the conductor;

at least one expanded polymeric layer around said insulating layer;

a circumferentially closed metal shield around said at least one expanded polymeric layer; and an impact protecting element in a position radially external to the metal shield, said impact protecting element comprising at least one non-expanded polymeric layer around said metal shield and at least one expanded polymeric layer radially external to said non-expanded polymeric layer.

2. The electrical cable according to claim 1, wherein the thickness of the expanded polymeric layer is from 1 to 2 times the thickness of the non-expanded polymeric layer.

3. A process for manufacturing an electric cable, comprising the steps of:

feeding a conductor at a predetermined feeding speed;

extruding a thermoplastic insulating layer in a position radially external to the conductor;

cooling the extruded insulating layer;

forming a circumferentially closed metal shield around said extruded insulating layer;

the time occurring between the end of the cooling step and the beginning of the shield forming step being inversely proportional to the feeding speed of the conductor.

4. The process according to claim 3, wherein the step of forming comprises the step of longitudinally folding a metal sheet around said extruded insulating layer.

5. The process according to claim 4, wherein the step of forming comprises the step of overlapping the edges of said metal sheet to form the metal shield.

6. The process according to claim 4, wherein the step of forming comprises the step of bonding the edges of said metal sheet to form the metal shield.

7. The process according to claim 3, further comprising the step of supplying the conductor in the form of a metal rod.

8. The process according to claim 7 wherein said thermoplastic polymer material is selected from: polyethylene (PE), polypropylene (PP), ethylene/vinyl acetate (EVA), ethylene/methyl acrylate (EMA), ethylene/ethyl acrylate (EEA), ethylene/butyl acrylate (EBA), ethylene/$\alpha$-olefin thermoplastic copolymers, polystyrene, acrylonitrile/butadiene/styrene (ABS) resins, polyvinyl chloride (PVC), polyurethane, polyamides, polyethylene terephthalate (PET), polybutylene terepthalate (PBT), and copolymers thereof or mechanical mixtures thereof.

9. The process according to claim 3, further comprising the step of applying a primer layer around the metal shield.

10. the process according to claim 9, wherein the step of applying the primer layer is carried out by extrusion.

11. The process according to claim 3, further comprising the step of applying an impact protecting element around said circumferentially closed metal shield.

12. The process according to claim 11 wherein the step of applying an impact protecting element comprises the step of applying a non-expanded polymeric layer around said metal shield.

13. The process according to claim 11, wherein the step of applying an impact protecting element comprises the step of applying an expanded polymeric layer.

14. The process according to claim 13, wherein the expanded polymeric layer is applied around a non-expanded polymeric layer.

15. The process according to claim 3, further comprising the step of applying an oversheath around the metal shield.

16. The process according to claim 15, wherein the oversheath is applied around an expanded polymeric layer.

17. The process according to claim 3, wherein the step of cooling the extruded insulating layer is carried out by longitudinally feeding the conductor with the thermoplastic insulating layer through an elongated cooling device.

18. The process according to claim 3, wherein the thermoplastic polymer material of the insulating layer is selected from: polyolefins, copolymers of different olefins, copolymers of an olefin with an ethylenically unsaturated ester, polyesters, polyacetates, cellulose polymers, polycarbonates, polysulphones, phenol resins, urea resins, polyketones, polyacrylates, polyamides, polyamines, and mixtures thereof.

19. The process according to claim 3, wherein the thermoplastic polymer material of the insulating layer includes a predetermined amount of a dielectric liquid.

* * * * *